US006640856B1

(12) United States Patent
Tucker

(10) Patent No.: US 6,640,856 B1
(45) Date of Patent: Nov. 4, 2003

(54) COLLAPSIBLE BAG ARRANGEMENT AND METHOD

(75) Inventor: Amy R. Tucker, Croton on the Hudson, NY (US)

(73) Assignee: Tumi, Inc., South Plainfield, NJ (US)

( * ) Notice: Subject to any disclaimer, the term of this patent is extended or adjusted under 35 U.S.C. 154(b) by 0 days.

(21) Appl. No.: 10/200,103

(22) Filed: Jul. 19, 2002

(51) Int. Cl.[7] ..... A45C 1/02
(52) U.S. Cl. ..... 150/130; 383/2; 383/4
(58) Field of Search ..... 150/100, 130, 150/123, 124; 140/103, 107; 383/4, 2, 55, 124, 78, 82, 83, 88, 89, 91

(56) References Cited

U.S. PATENT DOCUMENTS

| | | | | | |
|---|---|---|---|---|---|
| 924,172 | A | * | 6/1909 | Merzbach | 150/100 |
| 1,143,171 | A | * | 6/1915 | Bushwick | 150/100 |
| 1,251,404 | A | * | 12/1917 | Mills | 150/100 |
| 1,537,956 | A | * | 5/1925 | Mc Nally | 383/2 |
| 1,604,658 | A | * | 10/1926 | Post | 383/2 |
| 1,606,107 | A | * | 11/1926 | Simms | 383/2 |
| 3,031,121 | A | * | 4/1962 | Chase | 383/13 |
| 4,090,542 | A | * | 5/1978 | Hacker, Jr. | 383/29 |
| 4,856,570 | A | * | 8/1989 | Rushing et al. | 150/107 |
| 4,952,073 | A | * | 8/1990 | Wieland | 383/4 |
| 5,044,699 | A | * | 9/1991 | Duty | 383/37 |
| 5,879,083 | A | * | 3/1999 | Nelson et al. | 383/67 |
| 6,213,643 | B1 | * | 4/2001 | Lin | 383/127 |

* cited by examiner

*Primary Examiner*—Lee Young
*Assistant Examiner*—Lien Ngo
(74) *Attorney, Agent, or Firm*—Baker Botts LLP

(57) ABSTRACT

A collapsible bag arrangement includes a compartment for holding articles having at least a first side, a second side and a bottom. At least the first and second sides are constructed of a foldable material. A bottom strip has a middle portion, a first end portion and a second end portion. The first and second end portions are of bendable construction and extend outward beyond the length of the first and second sides. The first piece of a two-piece fastener attaches to the first portion of the bottom strip and the second piece of the two-piece fastener attaches to the second portion of the bottom strip. The arrangement is such that the first and second sides of the compartment are foldable to conform generally to the size and shape of the bottom strip and the first and second sides and the bottom of the compartment and the bottom strip are bendable to permit removably mating of the two-piece fastener so that the compartment is collapsed and maintained substantially within the perimeter of the bottom strip formed when the first and second portions of the bottom strip are fastened together.

20 Claims, 12 Drawing Sheets

COLLAPSIBLE BAG ARRANGEMENT AND METHOD

BACKGROUND OF INVENTION

1. Field of the Invention

The present invention relates to collapsible bags, and more particularly to a collapsible bag that is retainable in its collapsed position when not in use.

2. The Related Art

It has become increasingly common for individuals to carry collapsible bags in which items or articles can be carried or transported. The collapsible bags typically have hand or shoulder straps with which the bags are held. When the collapsible bags are not in use, they can be folded for storage. This is especially useful when an individual is travelling and may need more or different types of bags at the individual's travel destination or may need additional bags either during the trip to or the trip back from the destination but not for the entire round trip.

The actual transport or storage of a collapsible bag by the individual, however, is often somewhat of an inconvenience. For example, collapsible bags are not typically designed to be maintained in their collapsed state. Thus, there is a tendency for the bags to unfold, especially when the luggage in which they are stored are subjected to the harsh treatment often endured by luggage during travel. Moreover, collapsible bags often lack a bottom of sufficiently rigid construction to provide form to the bottom of the bag. Collapsible bags with a sufficiently rigid bottom construction often hinder the ability of the bag to be folded into a retainably collapsed state which is not entirely satisfactory.

SUMMARY OF THE INVENTION

It is an object of the present invention to fulfill the foregoing and other needs of the prior art by the provision of a collapsible bag arrangement that is retainable in its collapsed state. It is a further object of the invention to provide a collapsible bag arrangement with a sufficiently rigid bottom to provide form to the bottom of the collapsible bag.

These and other objects of the present invention are obtained by providing a collapsible bag arrangement having a compartment for holding articles which has at least a first side, a second side and a bottom. At least the first and second sides are constructed of a foldable material. The compartment has an opening at the top. The bottom has an outside surface and an inside surface. A bottom strip has a middle portion, a first end portion and a second end portion. The middle portion is attached to the outside surface of the bottom of the compartment. The first and second end portions are of bendable construction and extend outward beyond the ends of the first and second sides. A two-piece fastener is included. The first piece of the two-piece fastener attaches to the first portion of the bottom strip and the second piece of the two-piece fastener attaches to the second portion of the bottom strip. The arrangement is such that the first and second sides of the compartment are foldable to conform generally to the size and shape of the bottom strip and the first and second sides and the bottom of the compartment and the bottom strip are bendable to permit removably fastening of the two-piece fastener so that the compartment is collapsed and maintained substantially within the perimeter of the bottom strip formed when the first and second portions of the bottom strip are fastened together.

In one aspect of the invention, the first piece of the two-piece fastener is attached to the first portion of the bottom strip on the side of the bottom strip attached to the compartment bottom and the second piece of the two-piece fastener is attached to the second portion of the bottom strip on the side of the bottom strip opposite the side of the bottom strip attached to the compartment bottom.

In another aspect of the invention, the collapsible bag arrangement further includes a second two-piece fastener. The first piece of the second two-piece fastener is substantially identical to the first piece of the first two-piece fastener and is attached to the second end portion of the bottom strip at a position substantially symmetrical to the position of the first piece of the first two-piece fastener that is attached to the first end portion. The second piece of the second two-piece fastener is substantially identical to the second piece of the first two-piece fastener and is attached to the compartment above the point where the bottom is attached to the middle portion at a distance approximately the same as the distance between the first piece of the second two-piece fastener and the point where the bottom is attached to the middle portion. An additional second piece of the first two-piece fastener is included which is substantially identical to the second piece of the first two-piece fastener. The additional second piece of the first two-piece fastener is attached to the compartment above the point where the bottom is attached to the middle portion at a distance approximately the same as the distance between the first piece of the second two-piece fastener and the point where the bottom is attached to the middle portion. In this arrangement, when the collapsible bag is not in a collapsed configuration, the first piece of the first two-piece fastener is removably fastened to the additional second piece of the first two-piece fastener and the first and second pieces of the second two-piece fastener are removably fastened together.

In another aspect of the invention, the two-piece fasteners are snaps and each snap includes a male piece and a female piece. The first piece may be the female piece.

In still another aspect of the invention, the collapsible bag arrangement also has a carrying handle attached to the compartment proximate to the opening at the top of the compartment for carrying the bag. The carrying handle includes a first strap having a first strap end and a second strap end. Each strap end of the first strap attached to the compartment is proximate to the top of the first side of the compartment. A second strap includes a first strap end and a second strap end. Each strap end of the second strap attaches to the compartment proximate to the top of the second side of the compartment.

In yet another aspect of the invention, the top of the first and second sides of the compartment includes a sealing arrangement, such as a zipper arrangement, for sealing the opening of the compartment.

In another aspect of the invention, the collapsible bag arrangement further includes a sealable pouch attached to the inside surface of at least one of the first and second sides of the compartment. The sealable pouch may include a pouch zipper arrangement.

In another aspect of the invention, the collapsible bag has a lanyard and a snap hook, wherein the lanyard is attached to the inside surface of the compartment at one end and to the snap hook at the other end.

In a further aspect of the invention, each strap end of the first and second straps is attached to the outside of the sides of the compartment at a distance from the top of the sides such that when the compartment is sealed, the distance along the compartment between the first strap end of the first strap and the first strap end of the second strap is approximately the same as the width of the bottom strip and the distance along the compartment between the second strap end of the first strap and the second strap end of the second strap is approximately the same as the width of the bottom strip. In another aspect of the invention, each strap end of the first and second straps is attached to the outside of the sides of the compartment at a distance from the top of the sides such that when the compartment is sealed, the distance along the compartment between the first strap end of the first strap and the first strap end of the second strap is less than the width of the bottom strip and the distance along the compartment between the second strap end of the first strap and the second strap end of the second strap is less than the width of the bottom strip.

In another aspect of the invention, the collapsible bag arrangement has a second two-piece fastener. The first piece of the second two-piece fastener is substantially identical to the first piece of the first two-piece fastener and is attached to the second end portion of the bottom strip at a position substantially symmetrical to the position of the first piece of the first two-piece fastener that is attached to the first end portion. The second piece of the second two-piece fastener is substantially identical to the second piece of the first two-piece fastener and is attached to the compartment above the point where the bottom is attached to the middle portion at a distance slightly less than the distance between the first piece of the second two-piece fastener and the point where the bottom is attached to the middle portion. An additional second piece of the first two-piece fastener is included which is substantially identical to the second piece of the first two-piece fastener. The additional second piece of the first two-piece fastener is attached to the compartment above the point where the bottom is attached to the middle portion at a distance slightly less than the distance between the first piece of the second two-piece fastener and the point where the bottom is attached to the middle portion. In this aspect of the invention, the first piece of the first two-piece fastener is removably fastened with the additional second piece of the first two-piece fastener and the first and second pieces of the second two-piece fastener are removably fastened when the collapsible bag is not in a collapsed configuration.

In still another aspect of the invention, the bottom strip includes an area for displaying a trademark when the compartment is collapsed and maintained substantially within the perimeter of the bottom strip.

In another aspect of the invention, a first end of the first side of the compartment is stitched to a first end of the second side of the compartment and a second end of the first side of the compartment is stitched to a second end of the second side of the compartment. In a still further aspect of the invention, the compartment is constructed of a single piece of fabric for the first and second sides and the bottom. In one aspect of the invention, the bottom of the compartment is stitched to the bottom strip.

In another aspect of the invention, a method for retaining a collapsible bag in a collapsed configuration is provided that includes folding the sides of the bag on one side of the bottom of the bag in a manner to conform the sides of the bag substantially to the shape and size of the bottom of the bag; bending the bottom of the bag such that a first end portion of the bottom of the bag overlaps a second end portion of the bottom of the bag and such that the sides of the bag reside substantially inside the bent bottom of the bag; and fastening the first and second end portions together.

BRIEF DESCRIPTION OF THE DRAWINGS

For a more complete understanding of the present invention and the advantages thereof, reference may be made to the following description of exemplary embodiments thereof, taken in conjunction with the accompanying drawings, in which.

DESCRIPTION OF AN EXEMPLARY EMBODIMENT

Figure 1A:
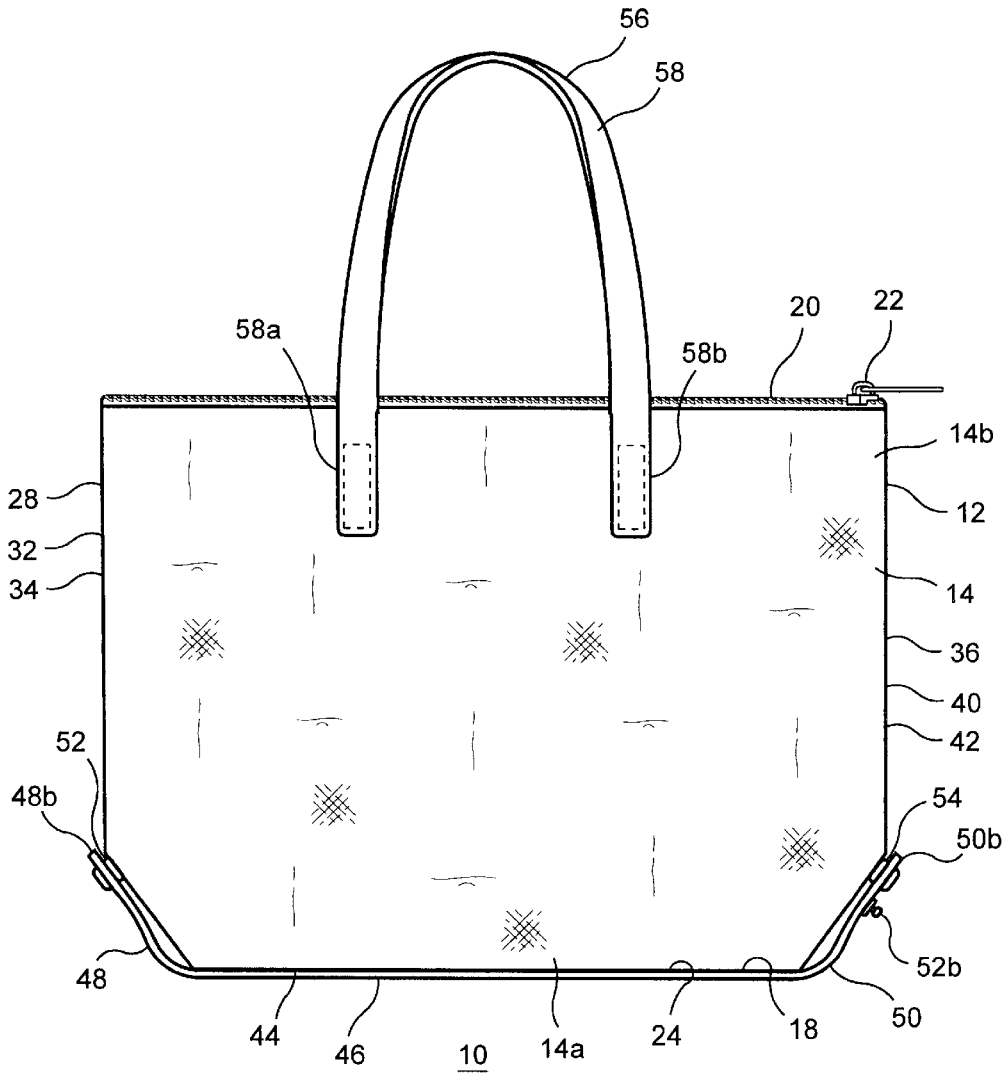
FIG. 1A is a front view of the collapsible bag in accordance with the invention in its configuration for holding articles.
Figure 1B:
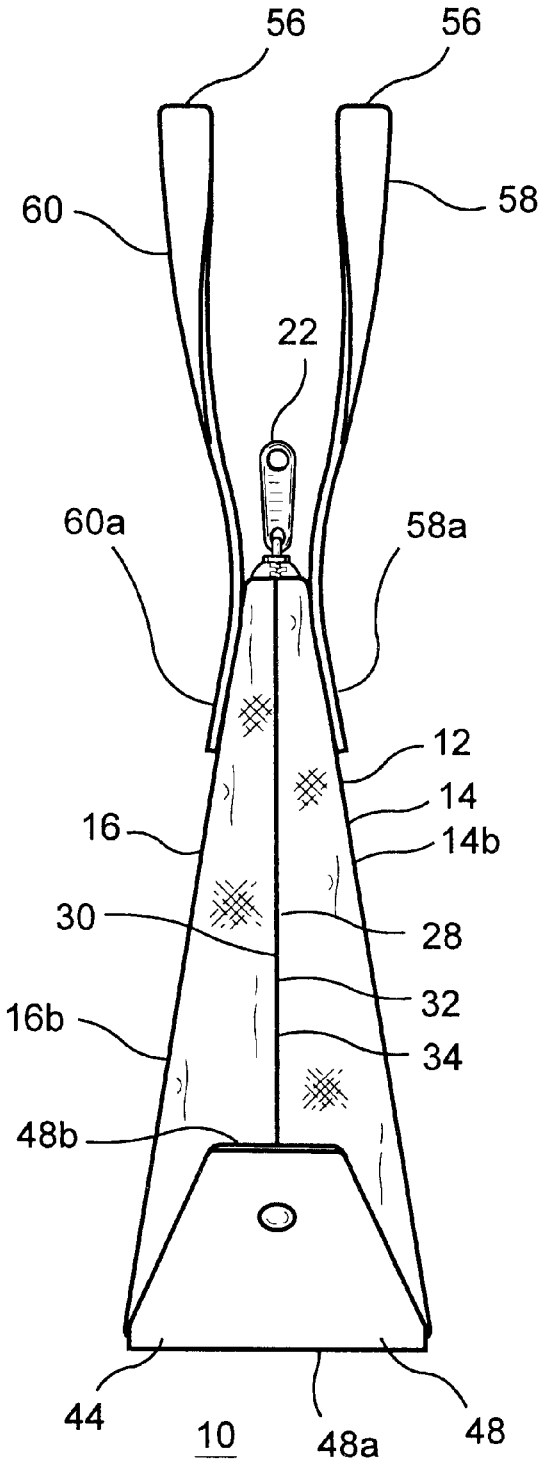
FIG. 1B is a side view of the collapsible bag of FIG. 1A, showing the bag in its configuration for holding articles.

FIGS. 1A and 1B depict a collapsible bag 10 that has a compartment 12 for holding articles (not shown). In a certain embodiment, although not necessary, the compartment 12 is constructed substantially of a single piece of fabric. The compartment 12 has a first side 14, a second side 16 and a bottom 18 in addition to an opening 20 at the top. Although not necessary, the opening 20 may be sealable. In a certain embodiment, the sealing arrangement for the compartment 12 is a zipper 22. Other sealing arrangements may include but are not limited to Velcro® strips. The bottom 18 has an outside surface 24 and an inside surface 26. A first end 28 of the first side 14 of the compartment 12 is stitched (not shown) to a first end 30 of the second side 16 of the compartment 12 forming a first seam 32 along a first end 34 of the compartment 12. A second end 36 of the first side 14 of the compartment 12 is stitched (not shown) to a second end 38 of the second side 16 of the compartment 12 forming a second seam 40 along a second end 42 of the compartment 12. The compartment 12 is constructed of a foldable, strong textile material such as a nylon fabric, although various textiles can be used for a variety of looks and seasonal selections. A trademark of the manufacturer or distributor (not shown) of the bag can be prominently displayed on one or both of the sides 14 and 16.

The bottom 18 of the compartment 12 is stitched (not shown) to a bottom strip 44. The bottom strip 44 is constructed of a bendable, sturdy material, such as leather, and outlines the general size and shape of the bottom 18 of the collapsible bag 10. The bottom strip 44 has a middle portion 46, a first end portion 48 and a second end portion 50. The middle portion 46 has a generally hour glass shape in that it is generally rectangular in shape except that the longer sides 46*a* and 46*b* of the middle portion 46 curve inward toward the center 46*c* of the middle portion 46. A trademark of the manufacturer or distributor of the bag 10 can be prominently displayed or engraved in the middle portion 46. The middle portion 46 is attached to the outside surface 24 of the bottom 18 of the compartment 12 via stitching (not shown) that contours to the shape of the middle portion 46 of the bottom strip 44. The first and second end portions 48 and 50 of the bottom strip 44 extend outward beyond the respective first and second ends 34 and 42 of the compartment 12. The first and second end portions 48 and 50 of the bottom strip 44 are of a symmetrical trapezoidal shape with the longest parallel side 48*a* and 50*a* of each formed by the stitching (not shown) in common with the middle portion 46.

A first female piece 52*a* of a first two-piece snap fastener 52 is attached to the first end portion 48 proximate to the far edge 48*b* of the first end portion 48 of the bottom strip 44. A first female piece 54*a* of a second two-piece snap fastener 54 is attached to the second end portion 50 proximate to the far edge 50*b* of the second end portion 50 at a point substantially symmetrical to the location of the first female piece 52*a* of the first two-piece snap fastener 52 on the first end portion 48 of the bottom strip 44. Other types of fasteners, including but not limited to Velcro® strips, may be used in lieu of the two-piece snap fasteners. The first and second female pieces 52*a* and 54*a* of the two-piece snap fasteners 52 and 54 are attached to the first and second end portions 48 and 50, respectively, of the bottom strip 44 on the side of the bottom strip 44 attached to the compartment bottom 18.

The male piece 52*b* of the first two-piece snap fastener 52 is attached to the second end portion 50 of the bottom strip 44 on the side of the bottom strip that is opposite to the side of the bottom strip attached to the compartment bottom 18 at a point between the middle portion 46 and the female piece 54*a* of the second two-piece snap fastener 54. An additional male piece 52*c* of the first two-piece snap fastener 52 is attached to the compartment 12 along the first seam 32 above the point where the bottom 18 is attached to the middle portion 46 at a distance approximately the same as the distance between the female piece 52*a* of the first two-piece snap fastener 52 and the point where the bottom 18 is attached to the middle portion 46.

The male piece 54*b* of the second two-piece snap fastener 54 is attached to the compartment 12 along the second seam 40 above the point where the bottom 18 is attached to the middle portion 46 at a distance approximately the same as the distance between the female piece 54*a* of the second two-piece snap fastener 54 and the point where the bottom 18 is attached to the middle portion 46. In a certain embodiment, the distance between the male pieces 52*c*, 52*b* along the first and second seams 32, 40 and the point where the bottom 18 is attached to the middle portion 46 may be less than the distance between the female pieces 52*a* and 54*a* of the first and second two-piece fasteners 52 and 54 and the point where the bottom 18 is attached to the middle portion 46. When the bag 10 is being utilized to hold articles, the male pieces 52*c* and 54*b* of the first and second two-piece snap fasteners 52 and 54 are fastened to the first and second female pieces 52*a* and 54*a* of the first and second two-piece snap fasteners 52 and 54.

The collapsible bag 10 also has a carrying handle 56 attached to the compartment 12 proximate to the opening 20 at the top for carrying the bag 10. The carrying handle 56 includes a first and a second strap 58 and 60, each having a first strap end 58*a*, 60*a* and a second strap end 58*b*, 60*b*. Each strap end 58*a*, 58*b*, 60*a*, 60*b* of the first and second straps 58 and 60 is stitched to the compartment 12 proximate to the top of the first and second sides 14 and 16 of the compartment at equal distances to the center 14*a* and 16*a* of the sides 14 and 16. In a certain embodiment, the straps 58 and 60 are leather. However, other materials, such as webbing, may be used for seasonal sub-groupings, for example. The lengths of the straps 58 and 60 can also vary as desired. For example, a longer strap length would be used when the bag 10 is used as a shoulder bag as opposed to a hand bag. Also, the size of the compartment 12 may affect the length of the straps. Similarly the width and thickness of the straps 58 and 60 may vary as desired.

Each strap end 58*a*, 58*b*, 60*a*, 60*b* of the first and second straps 58 and 60 is attached to the outside 14*b*, 16*b* of the sides 14 and 16 of the compartment 12 at a distance from the top of the sides wherein when the compartment 12 is sealed, the distance between the first strap end 58*a* of the first strap 58 and the first strap end 60*a* of the second strap 60 is approximately the same as the width of the bottom strip 44 and the distance between the second strap end 58*b* of the first strap 58 and the second strap end 60*b* of the second strap 60 is approximately the same as the width of the bottom strip 44. In a certain embodiment, each strap end 58*a*, 58*b*, 60*a*, 60*b* of the first and second straps 58 and 60 is attached to the outside 14*b*, 16*b* of the sides of the compartment 12 at a distance from the top of the sides 14 and 16 wherein when the compartment 12 is sealed, the distance between the first strap end 58*a* of the first strap 58 and the first strap end 60*a* of the second strap 60 is less than the width of the bottom strip 44 and the distance between the second strap end 58*b* of the first strap 58 and the second strap end 60*b* of the second strap 60 is less than the width of the bottom strip 44. The distance between the top of the compartment 12 and the highest point where the strap ends 58*a*, 58*b*, 60*a*, 60*b* are stitched to the sides of the compartment 12 relate partially to the shape of the top of the bag 10 and can be modified as desired to be either wider or narrower than the width of the bottom strip 44.

Figure 3:
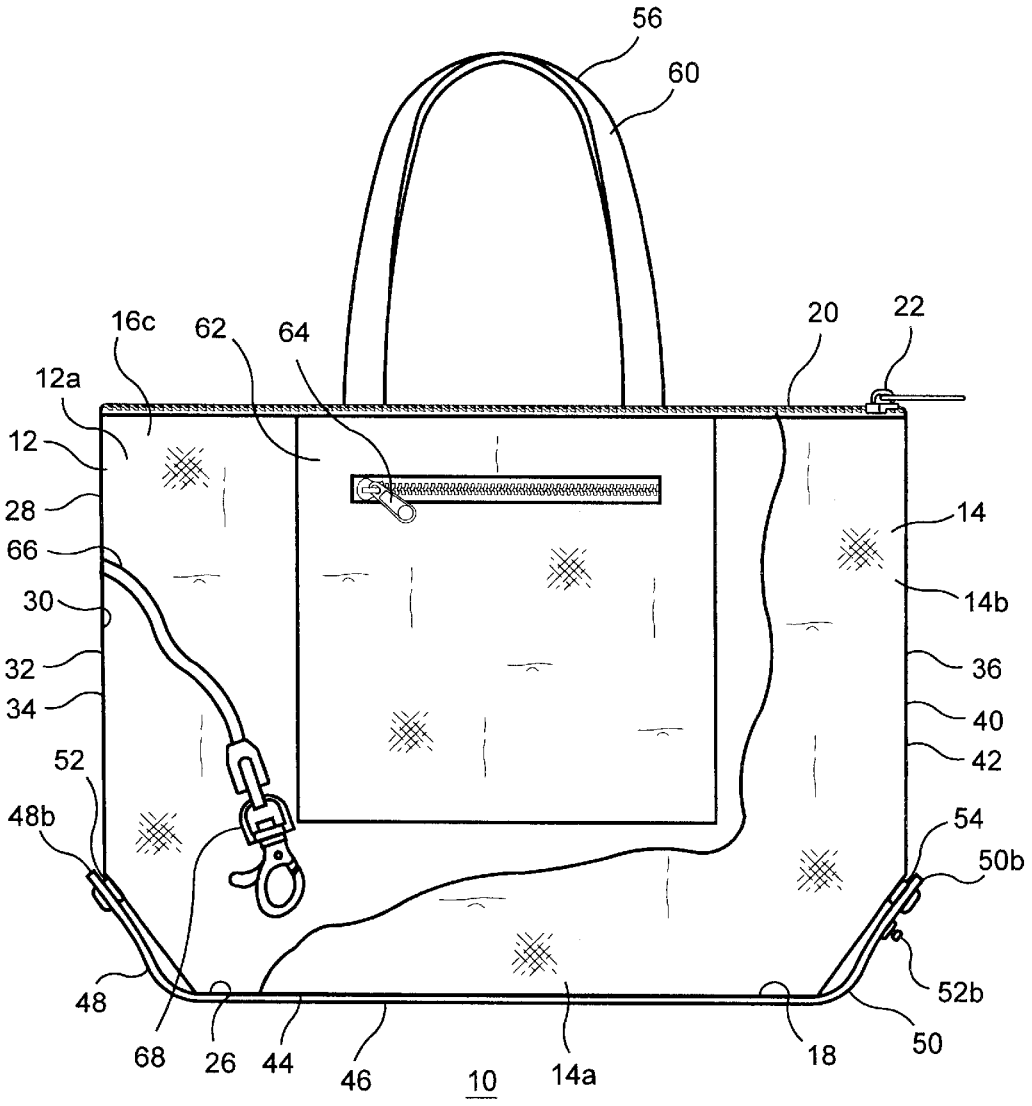
FIG. 3 is a front view similar to FIG. 1A, but partially cut-away showing a zippered pouch and a lanyard and snap hook assembly attached to the inside of the compartment.

As shown in FIG. 3, the collapsible bag arrangement 10 may further include a sealable pouch 62 attached to the inside surface 16*c* of the second side 16 of the compartment 12. In a certain embodiment, a zipper 64 is used, but other means of sealing, such as Velcro® strips, can also be used.

Also as shown in FIG. 3, the collapsible bag arrangement 10 may also include a lanyard 66 and a snap hook 68, also known as a latch clip or dog leash, wherein the lanyard 66 is attached to the inside surface 12*a* of the compartment 12 by the midpoint of either the first or second seam 32 or 40 at one end and to the snap hook 68 at the other end. In a certain embodiment, the lanyard 66 is leather. However, other materials, such as webbing, may be used for seasonal sub-groupings, for example. The lanyard and snap hook assembly 66, 68 may be used to attach keys or other personal items.

The size of the compartment 12 may be varied as desired. For example, a medium tote bag may have a length of approximately 15 inches, a height of approximately 11.5 inches and a width of approximately 3.5 inches, with the bottom strip 44 approximately 18 inches long, approximately 3.5 inches wide at its widest point (approximately 2.75 inches wide at its narrowest point in the middle portion 46 and approximately 1.375 inches at the far edges 48*b*, 50*b*) and approximately 0.125 inches thick. The middle portion 46 is approximately 12.25 inches in length and each end portion 48, 50 is approximately 2.875 inches in length. The center of the female pieces 52*a*, 54*a* are approximately 0.625 inches from the far edges 48*b*, 50*b* substantially along the centerline of the bottom strip 44. The center of the male piece 52*b* is approximately 1.5 inches from the far edge 50*b* along the centerline of the bottom strip 44 and the center of the male pieces 52*c* and 54*b* are along the seams 32, 40 approximately 2 inches from the point where the ends of the middle portion 46 are stitched to the bottom 18. For a medium tote bag, the straps may be approximately 0.75 inches wide, approximately 0.125 inches thick and approximately 34 inches long and having the strap ends 58*a*, 58*b*, 60*a*, 60*b* stitched approximately 1.5 inches from the top of the compartment 12. The medium tote bag may also have a zippered pouch approximately 8.5 inches long and approximately 7.25 inches in height and with a lanyard approximately 6 inches in length. When fastened in its collapsed state, excluding the carrying handle 56, the bag 12 (viewed as when held up by the carrying handle 56) is approximately 7.5 inches in length across, approximately 4 inches high and approximately 2.25 inches deep.

A large tote bag may have a length of approximately 19.5 inches, a height of approximately 13 inches and a width of approximately 4.25 inches, with a bottom strip 44 approximately 22.75 inches long (with a middle portion 46 of approximately 15.75 inches) and approximately 4.25 inches wide at its widest point. Each strap is about 37 inches long. The strap ends 58*a*, 58*b*, 60*a* and 60*b* are each attached approximately 1.75 inches from the opening 20. When fastened in its collapsed state, excluding the carrying handle 56, the bag 12 (viewed as when held up by the carrying handle 56) is approximately 9.75 inches in length across, approximately 5.5 inches high and approximately 2.75 inches deep.

A satchel may have a length of 12.75 inches, a height of 12.5 inches and a width of 2.5 inches, with a bottom strip 44 approximately 16 inches long (with a middle portion 46 of approximately 10.25 inches) and approximately 2.75 inches wide at its widest point. Each strap is about 15.5 inches long. The strap ends 58*a*, 58*b*, 60*a* and 60*b* are each attached approximately 1.25 inches from the opening 20. When fastened in its collapsed state, excluding the carrying handle 56, the bag 12 (viewed as when held up by the carrying handle 56) is approximately 6 inches in length across, approximately 3.5 inches high and approximately 2.75 inches deep. Note however that the dimensions of the medium and large totes and the satchel are given just as examples and thus other shapes and sizes of bags 10 and components thereof may be used.

Figure 2A:
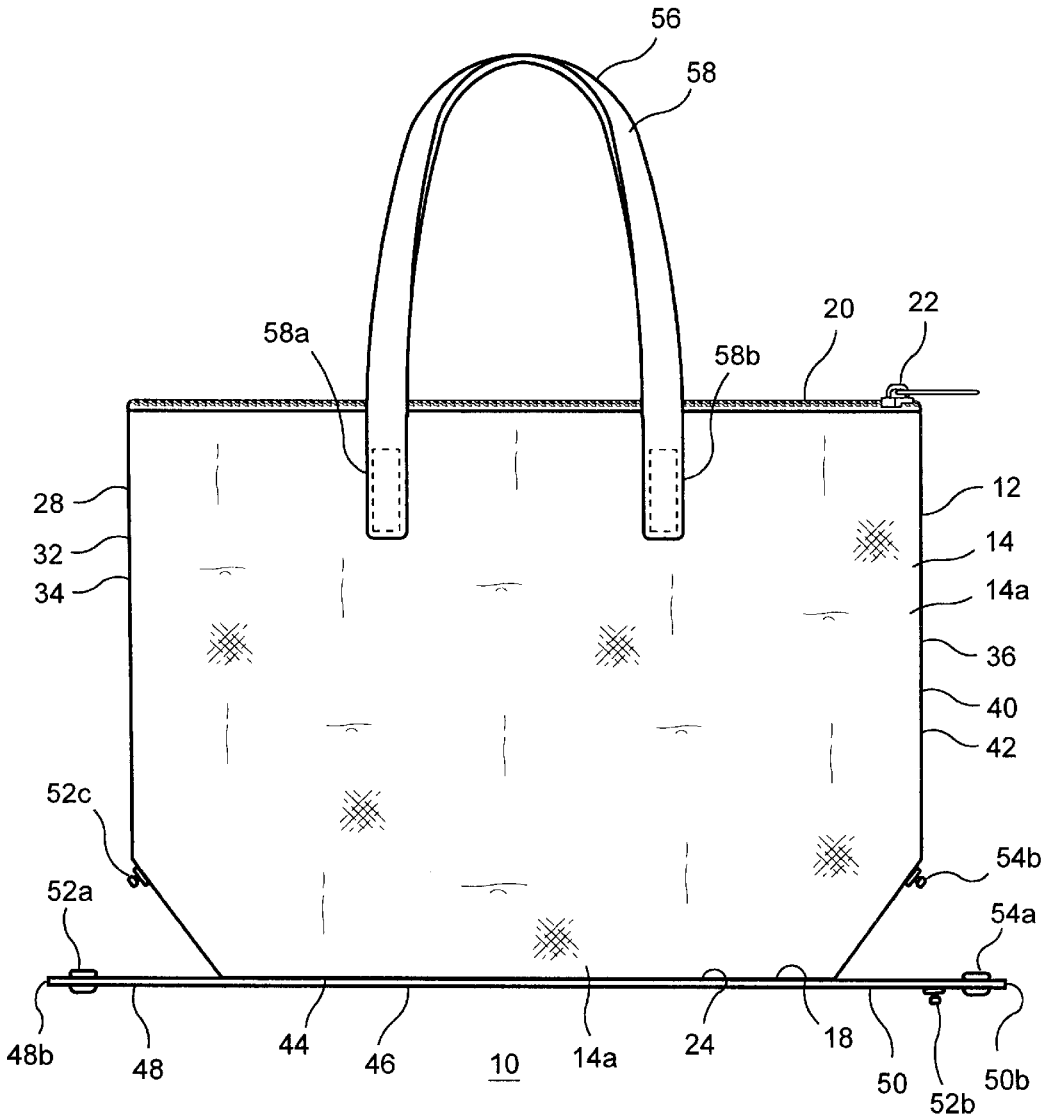
FIG. 2A is a front view of the collapsible bag in accordance with the invention in its uncollapsed configuration for holding articles, but with the end portions of the bottom strip not fastened to the compartment.
Figure 2B:
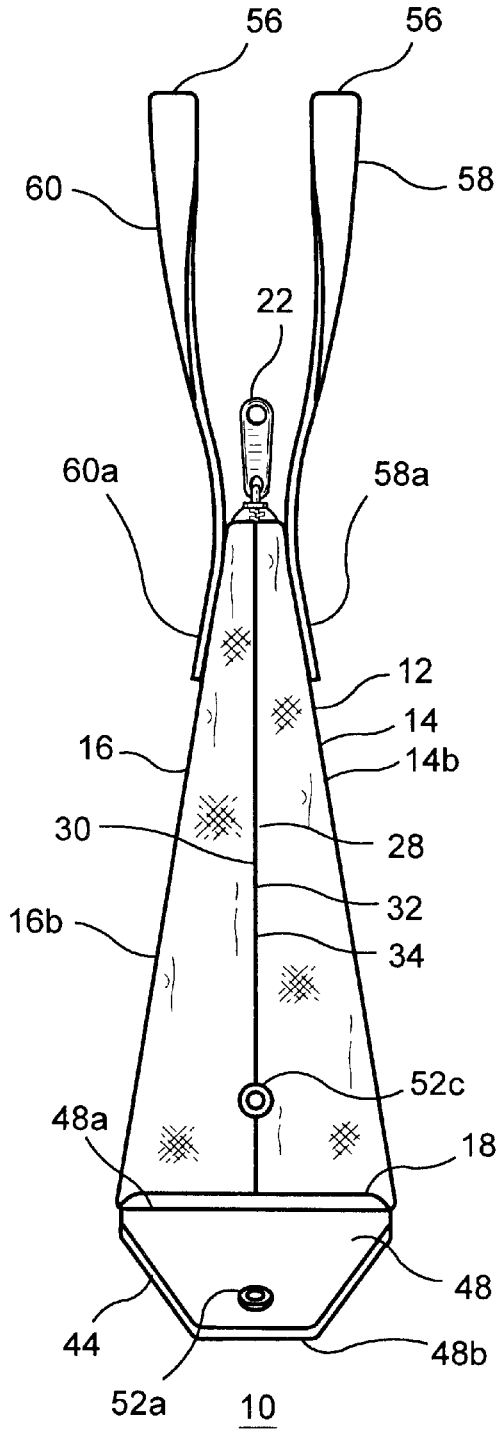
FIG. 2B is a side view of the collapsible bag of FIG. 2A.
Figure 2C:
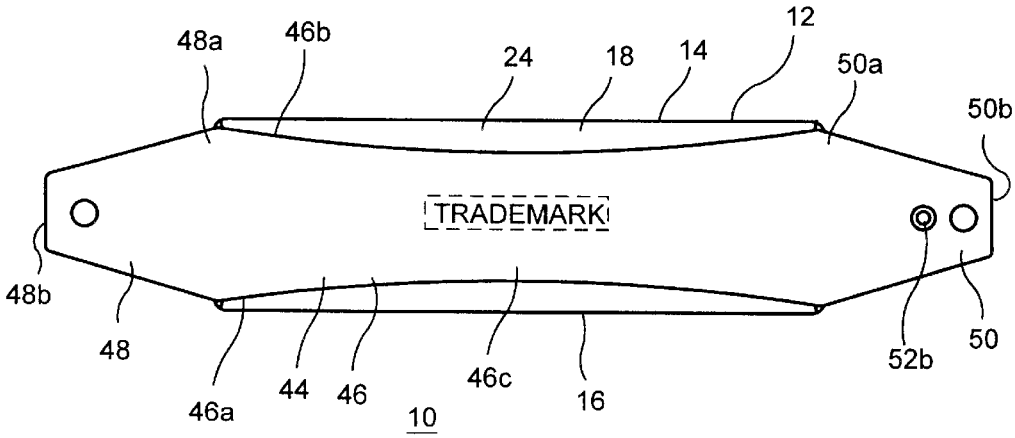
FIG. 2C is a bottom view of the collapsible bag of FIG. 2A.
Figure 4A:
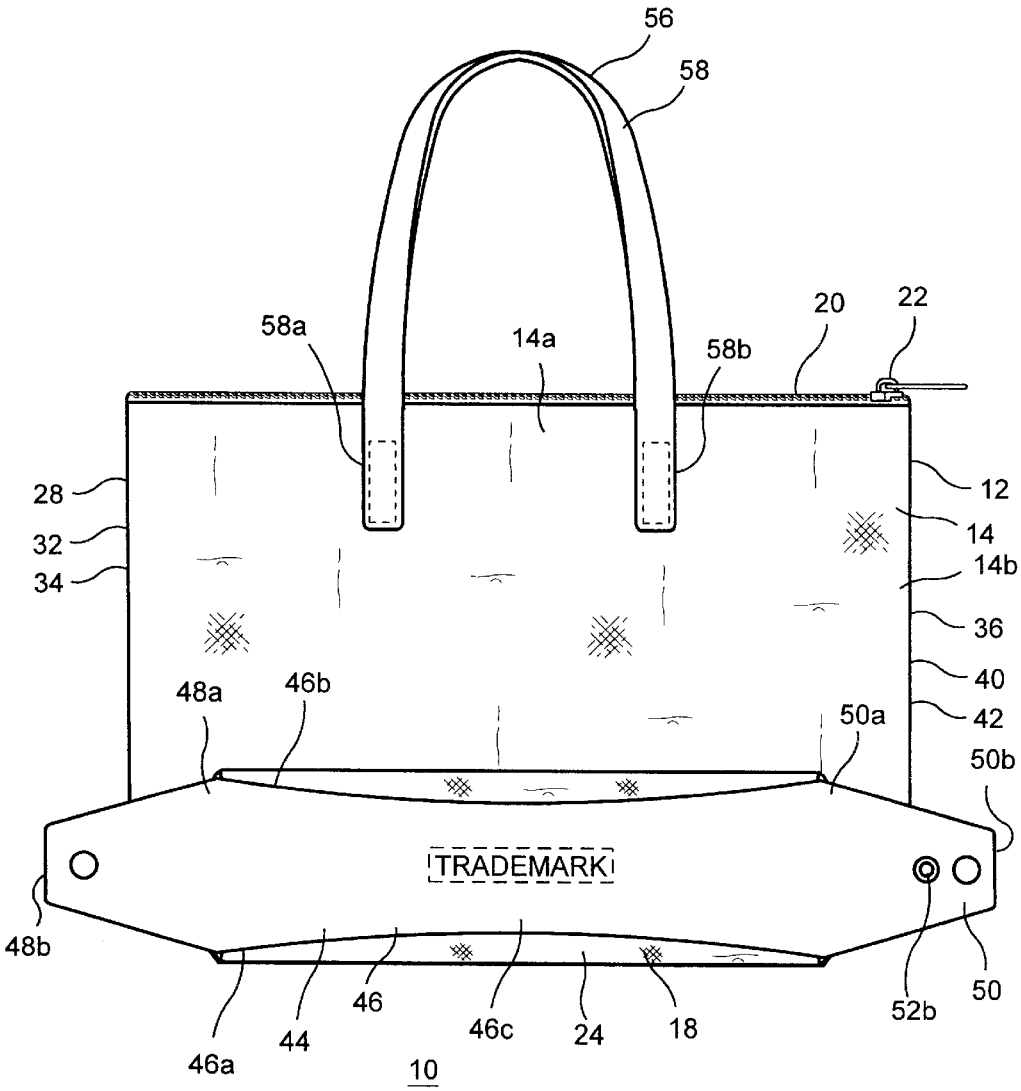
FIG. 4A is a front view of the collapsible bag of FIG. 2A, showing the bottom portion of the compartment folded once along the bottom strip.
Figure 4B:
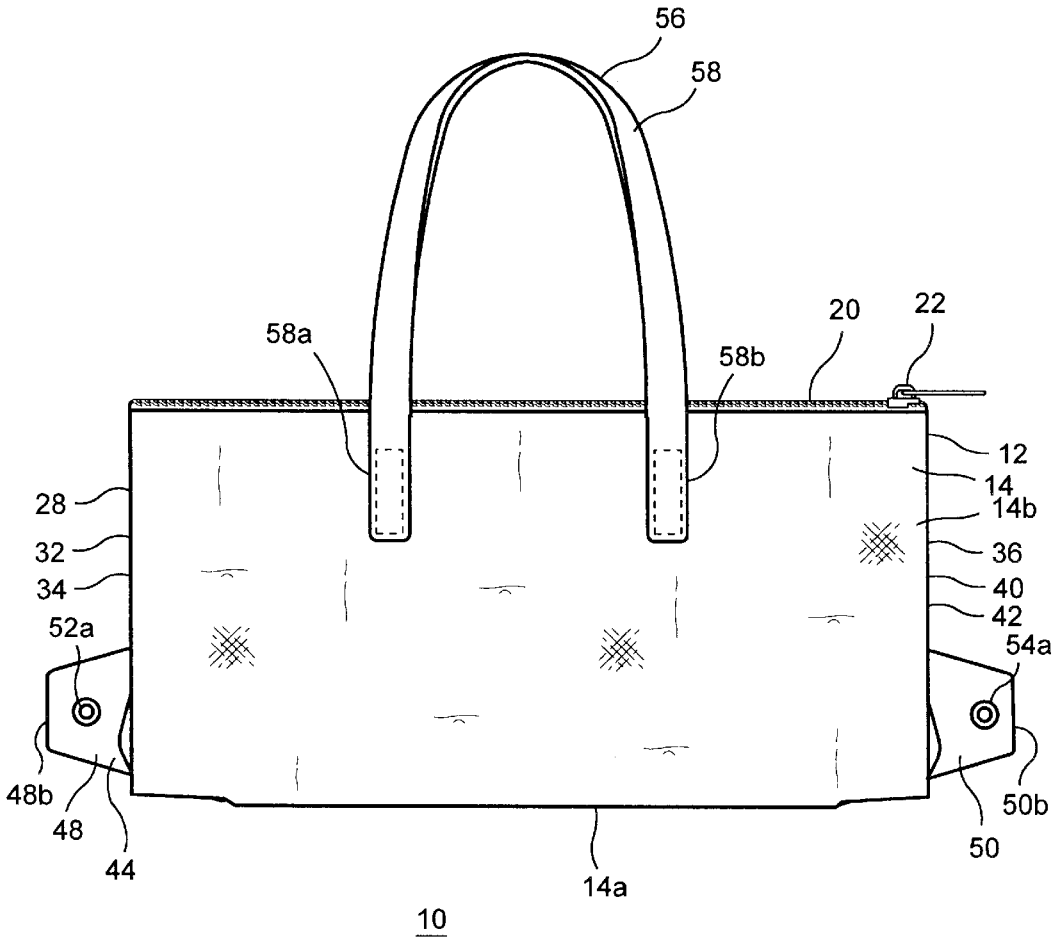
FIG. 4B is a front view of the collapsible bag of FIG. 2A, showing the bottom portion of the compartment folded twice along the bottom strip.
Figure 4C:
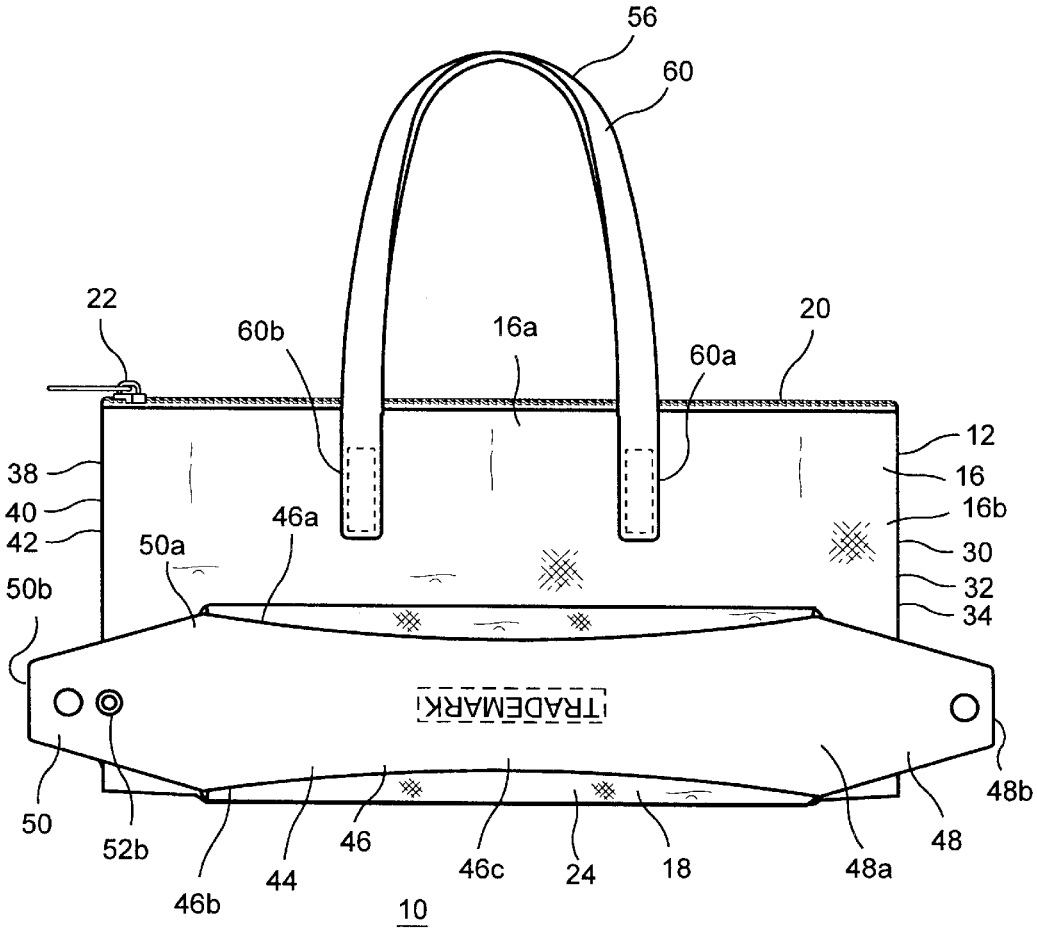
FIG. 4C is a back view of the collapsible bag of FIG. 2A, showing the bottom portion of the compartment folded twice along the bottom strip.
Figure 4D:
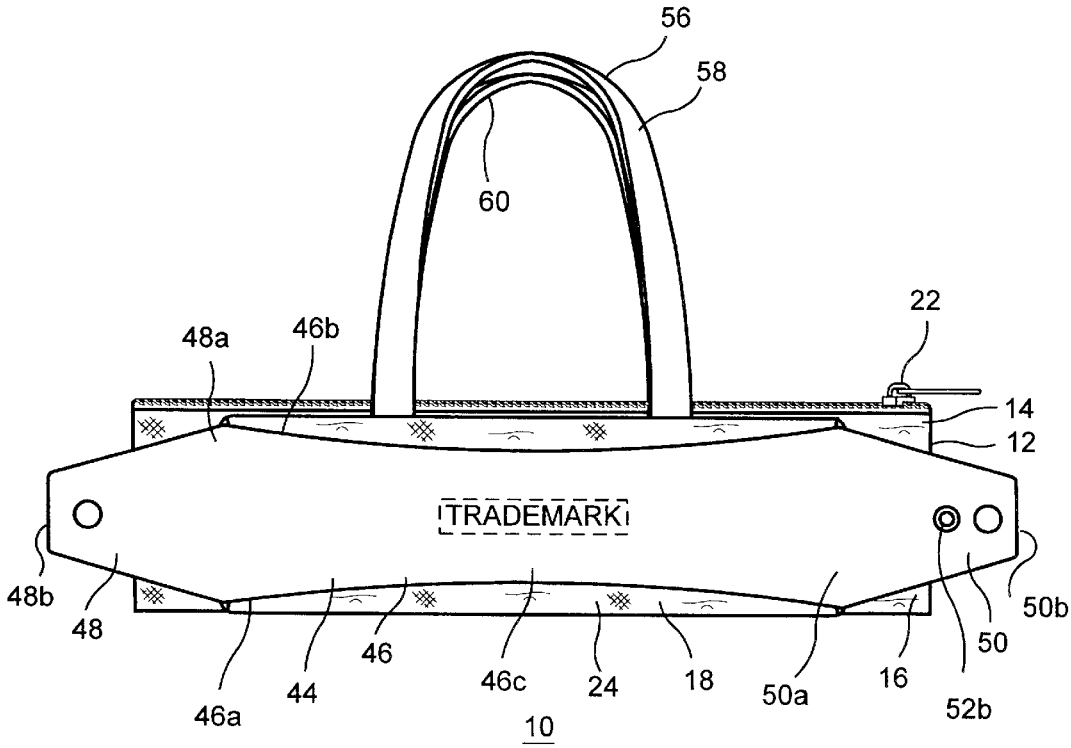
FIG. 4D is a front view of the collapsible bag of FIG. 2A, showing the bottom portion of the compartment folded three times along the bottom strip.
Figure 4E:
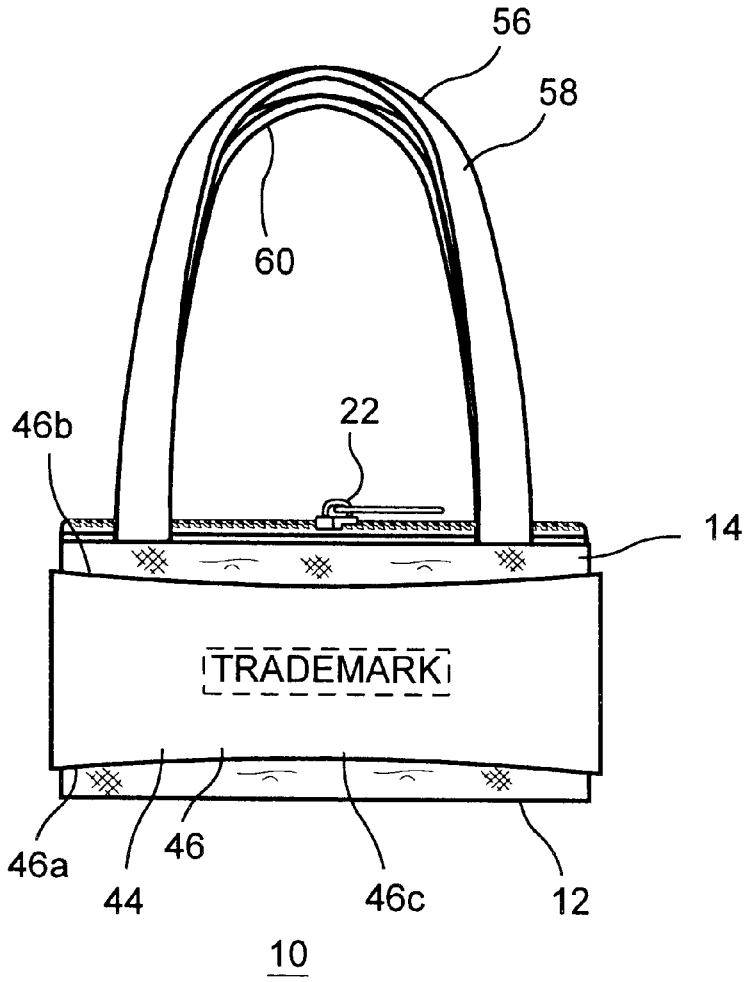
FIG. 4E is a front view of the collapsible bag of FIG. 4D, showing the end portions of the bottom strip bent behind the collapsible bag.
Figure 4F:
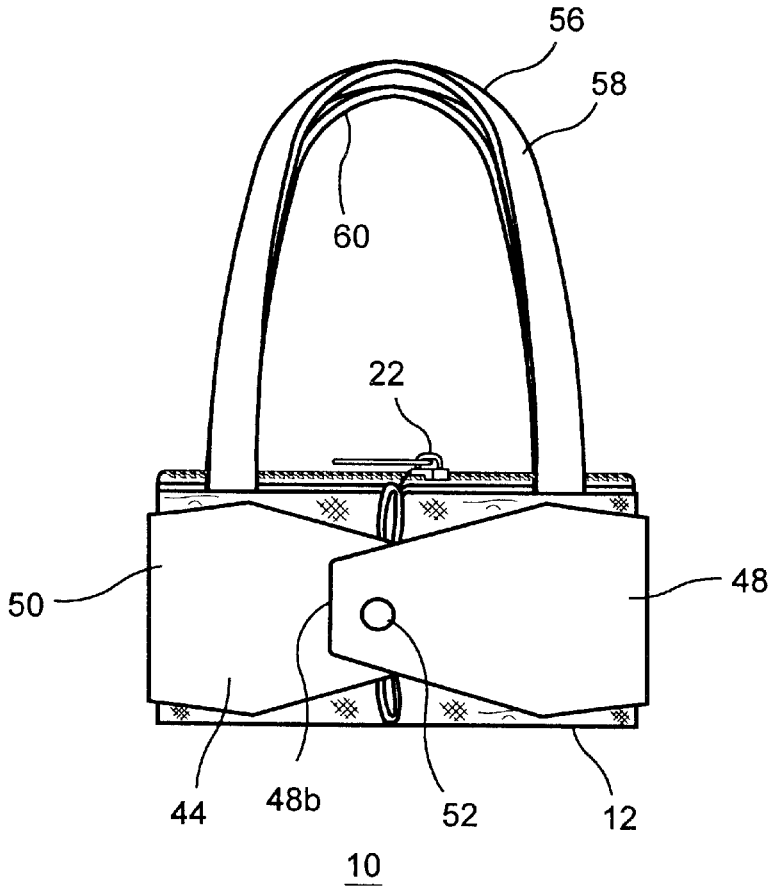
FIG. 4F is a back view of the collapsible bag of FIG. 4D, showing the end portions of the bottom strip bent behind the collapsible bag.

The method for collapsing the bag 10 and retaining it in a collapsed configuration is as follows. Initially, the bag 10 will be configured for use in holding articles as depicted in FIGS. 1A and 1B. This includes the first and second two-piece fasteners being fastened as depicted in FIG. 1A. The first and second two-piece snap fasteners 52 and 54 are then unfastened as shown in FIGS. 2A, 2B and 2C. Next, as shown in FIG. 4A, the bottom 18 of the compartment 12 is folded so that the bottom strip 44 faces away from the first side 14 of the compartment 12. As shown in FIG. 4B, the compartment 12 is folded a second time at a point proximate to what is now the top most edge of the bottom strip 44 (i.e., closest to the straps 58 and 60) so that the bottom strip 44 now faces away from the second side 16 of the compartment 12. The back view of this configuration is shown in FIG. 4C. As shown in FIG. 4D, the compartment 12 is folded a third time at a point proximate to what is now the top most edge of the bottom strip 44 (i.e., closest to the straps 58 and 60) so that the bottom strip once again faces away from the first side 14 of the compartment 12. Each time the compartment 12 is folded, it is folded in a way that includes folding the sides 14 and 16 of the compartment 12 on one side of the bottom strip 44 of the bag 10 in a manner to conform the sides of the compartment 12 substantially to the shape and size of the bottom strip of the bag 10. As shown in FIGS. 4E and 4F, the end portions 48 and 50 of the bottom strip 44 are next bent back such that the first end portion 48 of the bottom strip 44 overlaps the second end portion 50 of the bottom strip 44 and the first two-piece snap fastener 52 is fastened to retain the collapsible bag 10 in its collapsed state and such that the sides of the bag 10 reside substantially inside the bent bottom 18 of the bag 10. The compartment 12 is collapsed and maintained substantially within the perimeter of the bottom strip 44 formed when the first and second end portions 48 and 50 of the bottom strip 44 are fastened together with the female and male pieces 52*a* and 52*b*. As depicted in FIG. 4E, a trademark associated with the manufacturer or distributor of the bag 10 can be prominently displayed when the bag is in its collapsed state.

While the embodiment described herein utilizes three folds, a higher or lower number of folds may be used depending on the dimensions of the bag 10. Also, while the embodiment described herein has a ratio of compartment height to bottom strip width that permits folded segments of approximately equal widths, that is not necessary.

Although the invention has been described herein by reference to an exemplary embodiment thereof, it will be understood that such embodiment is susceptible of modification and variation without departing form the inventive concepts disclosed. All such modifications and variations, therefore, are intended to be encompassed within the spirit and scope of the appended claims.

What is claimed is:

1. A collapsible bag comprising:

a compartment for holding articles having at least a first side, a second side and a bottom, at least the first and second sides constructed of a foldable material, the compartment having an opening at the top, the bottom having an outside surface and an inside surface;

a bottom strip having a middle portion, a first end portion and a second end portion, the middle portion being attached to the outside surface of the bottom of the compartment, the first and second end portions being of bendable construction and extending outward beyond the ends of the first and second sides;

a first two-piece fastener, the first piece of the first two-piece fastener attached to the first end portion of the bottom strip and the second piece of the first two-piece fastener attached to the second end portion of the bottom strip;

wherein the first and second sides of the compartment are foldable to conform generally to the size and shape of the bottom strip and wherein the first and second sides and the bottom of the compartment and the bottom strip are bendable to permit removably fastening of the first two-piece fastener such that the compartment is collapsed and maintained substantially within the perimeter of the bottom strip formed when the first and second end portions of the bottom strip are fastened together.

2. The collapsible bag according to claim 1, wherein the first piece of the first two-piece fastener is attached to the first portion of the bottom strip on the side of the bottom strip attached to the compartment bottom and the second piece of the first two-piece fastener is attached to the second portion of the bottom strip on the side of the bottom strip opposite the side of the bottom strip attached to the compartment bottom.

3. The collapsible bag according to claim 1, further comprising:

a second two-piece fastener, the first piece of the second two-piece fastener being attached to the second end portion of the bottom strip at a position substantially symmetrical to the position of the first piece of the first two-piece fastener attached to the first end portion, the second piece of the second two-piece fastener being attached to the compartment above the point where the bottom is attached to the middle portion at a distance approximately the same as the distance between the first piece of the second two-piece fastener and the point where the bottom is attached to the middle portion; and an additional second piece of the first two-piece fastener, substantially identical to the second piece of the first two-piece fastener, the additional second piece of the first two-piece fastener being attached to the compartment above the point where the bottom is attached to the middle portion at a distance approximately the same as the distance between the first piece of the second two-piece fastener and the point where the bottom is attached to the middle portion;

wherein the first piece of the first two-piece fastener is removably fastenable to the additional second piece of the first two-piece fastener and the first and second pieces of the second two-piece fastener are removably fastenable when the collapsible bag is not in a collapsed configuration.

4. The collapsible bag according to claim 3, wherein the two-piece fasteners are snaps, each snap comprising a male piece and a female piece.

5. The collapsible bag according to claim 4, wherein the first piece is the female piece.

6. The collapsible bag according to claim 4, further comprising a carrying handle attached to the compartment proximate to the opening at the top for carrying the bag.

7. The collapsible bag according to claim 6, wherein the carrying handle comprises a first strap having a first strap end and a second strap end, each strap end of the first strap attached to the compartment proximate to the top of the first side of the compartment.

8. The collapsible bag according to claim 7, wherein the carrying handle comprises a second strap having a first strap end and a second strap end, each strap end of the second strap attached to the compartment proximate to the top of the second side.

9. The collapsible bag according to claim 6, wherein the top of the first and second sides of the compartment includes a sealing arrangement for sealing the opening of the compartment.

10. The collapsible bag according to claim 9, wherein the sealing arrangement is a zipper arrangement.

11. The collapsible bag according to claim 10, further comprising a sealable pouch attached to the inside surface of at least one of the first and second sides of the compartment.

12. The collapsible bag according to claim 11, further comprising a lanyard and a snap hook, wherein the lanyard is attached to the inside surface of the compartment at one end and to the snap hook at the other end.

13. The collapsible bag according to claim 8, wherein each strap end of the first and second straps is attached to the outside of the sides of the compartment at a distance from the top of the sides wherein when the compartment is sealed, the distance between the first strap end of the first strap and the first strap end of the second strap is approximately the same as the width of the bottom strip and the distance between the second strap end of the first strap and the second strap end of the second strap is approximately the same as the width of the bottom strip.

14. The collapsible bag according to claim 8, wherein each strap end of the first and second straps is attached to the outside of the sides of the compartment at a distance from the top of the sides wherein when the compartment is sealed, the distance between the first strap end of the first strap and the first strap end of the second strap is less than the width of the bottom strip and the distance between the second strap end of the first strap and the second strap end of the second strap is less than the width of the bottom strip.

15. The collapsible bag according to claim 1, wherein the bottom strip includes an area adaptable for displaying a trademark when the compartment is collapsed and maintained substantially within the perimeter of the bottom strip.

16. The collapsible bag according to claim 1 further comprising:

a second two-piece fastener, the first piece of the second two-piece fastener being attached to the second end portion of the bottom strip at a position substantially symmetrical to the position of the first piece of the first two-piece fastener attached to the first end portion, the second piece of the second two-piece fastener being attached to the compartment above the point where the bottom is attached to the middle portion at a distance slightly less than the distance between the first piece of the second two-piece fastener and the point where the bottom is attached to the middle portion; and an additional second piece of the first two-piece fastener, substantially identical to the second piece of the first two-piece fastener, the additional second piece of the first two-piece fastener being attached to the compartment above the point where the bottom is attached to the middle portion at a distance slightly less than the distance between the first piece of the second two-piece fastener and the point where the bottom is attached to the middle portion; and wherein the first piece of the first two-piece fastener is removably fastenable to the additional second piece of the first two-piece fastener and the first and second pieces of the second two-piece fastener are removably fastenable when the collapsible bag is not in a collapsed configuration.

17. The collapsible bag according to claim 1, wherein a first end of the first side of the compartment is stitched to a first end of the second side of the compartment and a second end of the first side of the compartment is stitched to a second end of the second side of the compartment.

18. The collapsible bag according to claim 17, wherein the compartment comprises a single piece of fabric for the first and second sides and the bottom.

19. The collapsible bag according to claim 18, wherein the bottom of the compartment is stitched to the bottom strip.

20. A method for retaining a collapsible bag in a collapsed configuration comprising:

folding the sides of the bag on one side of the bottom of the bag in a manner to conform the sides of the bag substantially to the shape and size of the bottom of the bag;

bending the bottom of the bag such that a first end portion of the bottom of the bag overlaps a second end portion of the bottom of the bag and such that the sides of the bag reside substantially inside the bent bottom of the bag; and fastening the first and second end portions together.

* * * * *